US006578380B1

(12) United States Patent
Pluchenik

(10) Patent No.: US 6,578,380 B1
(45) Date of Patent: Jun. 17, 2003

(54) HEXAGONAL BRILLIANT CUT DIAMOND

(75) Inventor: Seymour Pluchenik, New York, NY (US)

(73) Assignee: Diaco, New York, NY (US)

( * ) Notice: Subject to any disclaimer, the term of this patent is extended or adjusted under 35 U.S.C. 154(b) by 0 days.

(21) Appl. No.: 10/056,498

(22) Filed: Jan. 24, 2002

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | |
|---|---|---|---|
| 809,531 | A | 1/1906 | Schenck |
| 1,291,506 | A | 1/1919 | Heller |
| D141,259 | S | 5/1945 | Fine |
| D204,199 | S | 3/1966 | Westreich |
| D217,634 | S | 5/1970 | Bodner |
| 3,585,764 | A | 6/1971 | Huisman et al. |
| 3,763,665 | A | 10/1973 | Polakiewicz |
| 4,118,949 | A | 10/1978 | Grossbard |
| D273,372 | S | 4/1984 | Gennari |
| D287,232 | S | 12/1986 | Ishida |
| 5,072,549 | A | 12/1991 | Johnston |
| D327,452 | S | 6/1992 | Akselrod |
| D333,108 | S | 2/1993 | Akselrod |
| D340,670 | S | 10/1993 | Schachter |
| D348,024 | S | 6/1994 | d'Haene |
| D411,133 | S | 6/1999 | Alvarado |
| D431,492 | S | 10/2000 | Wagemans |
| D447,440 | S | 9/2001 | Friedman et al. |
| 6,305,193 | B1 | 10/2001 | Cheng |

OTHER PUBLICATIONS

A France Horlogere, "5 noubelles tailles pour le diamant", Nov. 1988.*

* cited by examiner

*Primary Examiner*—J. J. Swann
*Assistant Examiner*—Thomas Ho
(74) *Attorney, Agent, or Firm*—Stephen E. Feldman

(57) ABSTRACT

A gemstone having a crown and a pavilion, spaced by a girdle, has an overall hexagon configuration, the signature of the stone. Facets are cut in the crown of the stone defining an hexagon table and an hexagram in the crown. Six (6) trapezoids frame the hexagram and high light the signature of the stone. Facets are cut in the pavilion of the stone so that the hexagonal signature of the stone is maintained. A sharp, six (6) pointed geometric figure is formed by six (6) trapezoid facets cut in the pavilion of the stone, each trapezoid extends from the apex of the stone, toward the girdle. Pairs of triangle facets cut in conjunction with the trapezoids soften the sharp, six (6) pointed geometric figure. The hexagonal figure on the pavilion which is symmetrical with the hexagram in the crown and with the signature of the stone.

6 Claims, 1 Drawing Sheet

HEXAGONAL BRILLIANT CUT DIAMOND

BACKGROUND OF THE INVENTION

1. Field of the Invention

The present invention relates to brilliant cut gemstones, particularly brilliant cut diamonds. The diamond includes a crown and a pavilion separated by a girdle. The diamond has a particular general shape and the surface of the diamond is cut into brilliant facets the geometric shape of which maintain the particular general shape of the diamond.

2. Prior Art

Gemstones are generally cut with facets forming the exterior surface of the stone. The surface of the facets are then polished to obtain the brilliance, dispersion and/or scintillation desired from the gem. Facets cut in a gemstone may also form a geometric figure or design. The prior art is replete with teachings making gems from gemstones by cutting facets in the surface of the stone and then polishing the surface of the facet to obtain the brilliance and scintillation desired, when the gem is exposed to light. Facets are usually cut in the crown and in the pavilion of the stone.

An example of some prior art utility patents that teach crown facets and pavilion facets on a gemstone include:

| | | |
|---|---|---|
| U.S. 809,531 | issued to Schenck | Jan. 09, 1906 |
| U.S. 1,291,506 | issued to Heller | Jan. 14, 1919 |
| U.S. 3,585,764 | issued to Huisman, et al | Jun. 22, 1971 |
| U.S. 3,763,665 | issued to Polakiewicz | Oct. 09, 1973 |
| U.S. 4,118,949 | issued to Grossbard | Oct. 10, 1978 |
| U.S. 5,072,549 | issued to Johnston | Dec. 17, 1991 |
| U.S. 6,305,193 B1 | issued to Cheng | Oct. 23, 2001 |

The patent to Schenck (U.S. Pat. No. 809,531) teaches forming an eight (8) sided, octagon, table on the crown of a stone with crown facets having circular edges defining the upper edge of the girdle of the stone, between the crown and the pavilion. Pavilion facets adjacent the girdle also have circular edges defining the lower edge of the girdle. The facets cut in the stone are for providing brilliance. The patent to Heller (U.S. Pat. No. 1,291,506) teaches cutting facets in a gemstone so that all the pavilion facets are cut and polished to provide brilliance to the stone. The crown has a six (6) hexagon table with a blend of bright facets and dull facets around the polished table of the crown. The patent to Huisman, et al (U.S. Pat. No. 3,585,764) the cutting of a stone to produce 72 pavilion facets, polishing the girdle to a 90 degree edge and cutting 38 facets in the girdle. The patent to Grossbard (U.S. Pat. No. 4,118,949) teaches a step cut diamond in generally rectangular or emerald cut shape. The crown has a generally rectangular table with a series of trapezoid cut facets defining the girdle of the stone. The patent to Polakiewicz (U.S. Pat. No. 3,763,665) teaches cutting a gemstone so that the crown is in geometric parts. An octagonal table is defined on the crown by a plurality of trapezoidal facets, with each trapezoid facet having an edge common to a triangular facet. The pavilion of the stone is fully faceted in identical cut quadrants. The patent to Cheng (U.S. Pat. No. 6,305,193 B1) teaches a gemstone cut with an octagon shaped table with facets extending from the table to a girdle extending around the circular stone. The patent to Johnston (U.S. Pat. No. 5,072,549) teaches a method of cutting a gemstone to form a pentagonal shaped gem. The facets produce a five (5) pointed star in the crown of the stone.

It will be noticed that none of these prior art patents teach cutting facets into a gemstone to make the gemstone a brilliant gem where the gem is in the form of a geometric pattern and the facets together, form the same geometric pattern of the gem.

An example of some prior art design patents that show crown and pavilion facets cut on a gemstone are:

| | |
|---|---|
| U.S. Des. 141,259 issued to Fine | May 15, 1945 |
| U.S. Des. 204,199 issued to Westreich | Mar. 29, 1966 |
| U.S. Des. 217,634 issued to Bodner | May 19, 1970 |
| U.S. Des. 273,372 issued to Gennari | Apr. 10, 1984 |
| U.S. Des. 287,232 issued to Ishida | Dec. 16, 1986 |
| U.S. Des. 327,452 issued to Akselrod | Jun. 30, 1992 |
| U.S. Des. 333,108 issued to Akselrod | Feb. 09, 1993 |
| U.S. Des. 340,670 issued to Schachter | Oct. 26, 1993 |
| U.S. Des. 348,024 issued to d'Haene | Jun. 21, 1994 |
| U.S. Des. 411,144 issued to Alvarado | Jun. 22, 1999 |
| U.S. Des. 431,492 issued to Wagemans | Oct. 03, 2000 |

The design patents to Schachter (U.S. Pat. No. 340,670) and d'Haene (U.S. Pat. No. 348,024) each show a stone which has an eight (8) sided, octagon table defined on the crown with the stone in a generally octagon configuration. The pavilion of the stone has facets that do not maintain the octagon configuration of the stone. The design patents to Akselrod (U.S. Pat. No. 333,108) and Akselrod (U.S. Pat. No. 327,412) and to Ishida (U.S. Pat. No. 287,232) each show a gemstone with an eight (8) sided, octagon shaped table on the crown of a generally round shaped stone. The facets cut in the pavilion of the stone do not carry out the general shape of the stone, which is round, nor the geometric design of the table on the crown, which is octagon. The design patents to Alvarado (U.S. Pat. No. 411,133) and to Bodner (U.S. Pat. No. 217,634) each show a stone cut with an hexagon table design in the crown. Alvarado shows a stone with a generally hexagon shape. Bodner shows a circular shaped, round stone. Each design shows facets cut in the pavilion of the respective stone but neither stone carries the shape of the stone in the design cut in the pavilion. The design patent to Gennari (U.S. Pat. No. 273,372) shown a tear drop shaped stone with a floral design formed by the facets. The design patent to Fine (U.S. Pat. No. 141,259) shows a gemstone with a round configuration with a ten (10) sided table defined by the facets cut in the crown.

It will be noticed further that none of the design patents show a stone with a common geometric signature carried throughout the cuts in the stone.

SUMMARY OF THE INVENTION

The present invention provides a gemstone, such as a diamond, for example, cut into a gem having a geometric configuration, when viewed from the top of the stone. Facets cut in the crown of the stone provide a table on the crown which is directly related to the geometric configuration or signature of the stone. Triangular facets cut in the crown, with each triangle having a leg that is common with an edge of the table in the crown, define a second geometric figure in the crown which is directly related to the signature of the stone and to the configuration of the table in the crown. A plurality of trapezoid shaped facets are cut in the crown, the ends of which abut each other defining the perimeter of the stone. The width of each trapezoid facet is a minor fraction of the distance between the virtual center of the crown and the girdle of the stone. The signature of the stone is high lighted by the trapezoid shape facets which also frame the second geometric figure and the table cut in the crown.

The girdle, following the signature of the stone, separates the crown from the pavilion of the stone. A plurality of trapezoid shaped facets are cut in the pavilion, each trapezoid facet extending from the apex of the pavilion toward the girdle of the stone. Each trapezoid facet falls uniformly short of the girdle of the stone. The trapezoid facets form a sharp geometric figure in the pavilion that is related in both position and configuration to the signature of the stone and to the geometric figure in the crown of the stone. The sharpness of the geometric figure cut in the pavilion is softened by pairs of triangular cut facets. Each softening triangular facet has one leg common with a leg of a trapezoid, one leg common with the leg of an adjacent softening triangle and one free leg. A plurality of generally pentagon facets separate the softened geometric figure cut in the pavilion from the girdle of the stone. The width of each pentagon shaped facet that is parallel to the shortest line between the apex of the pavilion and the girdle of the stone is a minor fraction of the shortest distance between the apex of the pavilion and the girdle separating the crown from the pavilion.

From another aspect the present invention provides a gemstone, for example, a diamond cut into a gem having a hexagon configuration. Facets cut into the crown of the stone provide a table in the crown which is directly related to and offset from the hexagon configuration, which is the signature of the stone. Triangular shaped facets, cut in the crown, define a hexagram which is directly related to the hexagon table cut in the crown. A plurality of trapezoid facets, each abutting an adjacent trapezoid in the plurality and at a point of the hexagram, define the perimeter of the crown of the stone. The width of each trapezoid is a minor fraction of the distance between the virtual center of the crown and the girdle of the stone. The signature of the stone is high lighted by the trapezoid cut facets.

A set of six (6) trapezoid shaped facets are cut into the pavilion of the stone, each trapezoid facet of the six (6) facets extending from the apex of the pavilion toward the girdle and defining a sharp six (6) pointed star. Six (6) pair of triangle shaped facets are cut in the pavilion with each pair of triangle facets having a common leg and each triangle facet having one leg common with a leg of a trapezoid, soften the sharp six (6) pointed star, the center of which is the apex of the pavilion. Both the geometrical configuration and the position of the six (6) pointed star are related to the signature of the stone and the hexagram in the crown. A set of six (6) pentagon facets, each extending from the girdle of the stone toward the apex of the stone make contact with the softened six (6) pointed star. The width of each pentagon facet that is parallel to the shortest line between the apex of the pavilion and the girdle of the stone is a minor fraction of the distance between the apex of the pavilion and the girdle of the stone.

BRIEF DESCRIPTION OF THE DRAWINGS

The following description of a preferred embodiment of the invention will best be understood when read in conjunction with the drawings in which.

DETAILED DESCRIPTION OF THE INVENTION

It will be understood by those familiar with the art that the present invention provides a brilliant gem, preferably a diamond, with a crown and a pavilion separated by a girdle. In it preferred embodiment, the crown includes a table in the form of a flat hexagon with triangular cut facets defining a hexagram. The hexagon shape of the stone, the signature of the stone, is high lighted by six (6) trapezoidal facets.

The pavilion is cut with six (6) trapezoidal facets forming a sharp six (6) pointed star, the geometry of which is softened by six (6) pair of triangular cut facets. The signature of the stone is the hexagon, the table in the crown is a hexagon, the crown has triangular facets defining a hexagram and the face of the crown is framed with an hexagon frame that high lights the signature of the stone. The pavilion of the stone is cut into facets that define a sharp six (6) pointed star with six (6) pair of triangular facets that soften the sharpness of the star. Six (6) pentagon cut facets separate the softened six (6) pointed star, centered on the apex of the pavilion, from the girdle of the stone. There is direct relationship of both position and form between the geometric figures defined by the facets cut in the gemstone. The facets are cut and polished to provide a brilliant gem.

Figure 1:
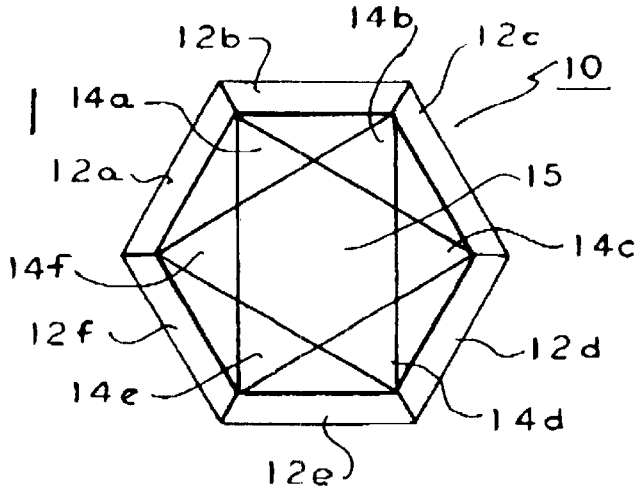
FIG. 1 is a pictorial representation of the invention as viewed from the top.
Figure 2:
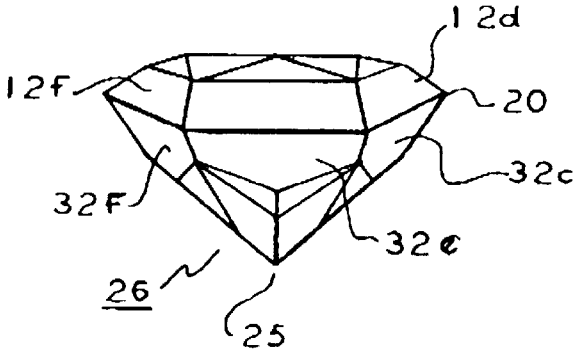
FIG. 2 is a pictorial side view of the invention represented in FIG. 1.
Figure 3:
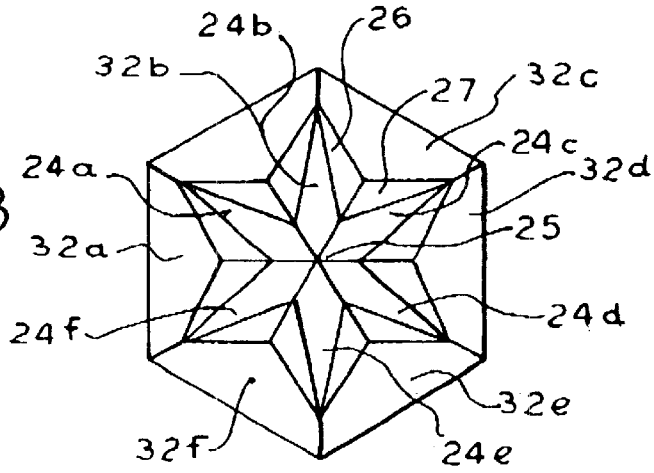
FIG. 3 is a pictorial bottom view of the invention represented in FIG. 1.

Referring to FIG. 1, a gemstone cut into a hexagon shaped gem is shown in a preferred embodiment of the invention. The six (6) sides of the hexagon gem are high lighted by trapezoid facets 12*a*, 12*b*, 12*c*, 12*d*, 12*e* and 12*f*. The six (6) triangular facets 14*a*, 14*b*, 14*c*, 14*d*, 14*e* and 14*f* define a hexagram. The table 15 defines a hexagon. Referring to FIG. 2. The framing trapezoidal facets 12*d*, 12*e* and 12*f* are shown above and adjacent the girdle 20. The apex 25 of the pavilion 26 is represented.

The trapezoid facets 24*a*, 24*b*, 24*c*, 24*d*, 24*e* and 24*f* cut in the pavilion, extend from the apex 25 and form a sharp six (6) pointed star. The sharpness of the six (6) pointed star is softened by six (6) pair of triangular cut facets 26/27 (only one pair being identified). A plurality of six (6) pentagon shaped facets, each of which have one side common with the girdle, separate the softened six (6) pointed star from the girdle of the stone. The width of each pentagon shaped facet parallel to the shortest line between the apex 25 and the girdle 20 is a minor fraction of the distance between the apex 25 and the girdle 20.

It will be noted that each point of the six (6) pointed star defined by facets cut in the pavilion, are in coincidence with each point of the hexagram in the crown, each of which are in coincidence with the points defining the signature of the gem.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention defined in the appended claims.

What is claimed is:

1. A hexagonal gemstone cut into a brilliant gem comprising:

a) a crown and a pavilion separated by a girdle, said crown defined by a first multi-sided geometric configuration;

b) a table defined in said crown by said first multi-sided geometric configuration, said crown including a plurality of triangular facets cut in said crown for defining a second multi-sided geometric configuration, said second multi-sided geometric configuration related to said first multi-sided geometric configuration; and c) a plurality of trapezoid shaped facets cut in said pavilion, each trapezoid shaped facet extending from an apex of said pavilion, said plurality of trapezoid shaped facets defining a sharp, multi-pointed star, said sharp, multi-pointed star related to said first multi-sided geometric configuration and to said second multi-sided geometric configuration; and d) a plurality of pairs of triangular facets cut in said pavilion where each triangular facet of said plurality of pairs of triangular facets have a leg which is common to an adjacent said triangular facet;

e) in which said each triangular facet of said plurality of pairs of triangular facets has a leg which is common with a leg of a trapezoid facet of said plurality of trapezoid facets.

2. A gemstone as in claim 1 in which said first multi-sided geometric configuration is a hexagon.

3. A gemstone as in claim 2 and in which said second multi-sided geometric configuration is a hexagram.

4. A gemstone as in claim 3 in which said sharp multi-sided pointed star is a six (6) pointed star.

5. A gemstone cut into a brilliant gem comprising:

a) a crown cut into a hexagon configuration;

b) a girdle circumscribing said crown;

c) a pavilion separated from said crown by said girdle;

d) a plurality of trapezoidal shaped facets cut in pavilion, each trapezoidal shaped facet of said plurality of trapezoidal shaped facets extending from an apex of said pavilion and defining a sharp six (6) pointed star, said sharp six (6) pointed star extending toward said girdle and terminating short of said girdle; and e) a plurality of pairs of triangular shaped facets cut in said pavilion where each triangular facet of said plurality of pairs of triangular facets has a leg that is common with another triangular shaped facet of said plurality of triangular shaped facets;

f) wherein said each triangular shaped facet has a leg common with a leg of a trapezoidal shaped facet.

6. A gemstone as in claim 5, wherein said plurality of pairs of triangular shaped facets combine with said plurality of trapezoidal shaped facets for providing a softened six (6) pointed star.

* * * * *